US011292566B2

(12) United States Patent
They

(10) Patent No.: US 11,292,566 B2
(45) Date of Patent: Apr. 5, 2022

(54) FLOTATION DEVICE FOR A PADDLE

(71) Applicant: They, Galveston, TX (US)

(72) Inventor: They, Galveston, TX (US)

( * ) Notice: Subject to any disclaimer, the term of this patent is extended or adjusted under 35 U.S.C. 154(b) by 163 days.

(21) Appl. No.: 16/810,633

(22) Filed: Mar. 5, 2020

(65) Prior Publication Data

US 2021/0276684 A1 Sep. 9, 2021

(51) Int. Cl.
*B63H 16/04* (2006.01)
*B63B 32/40* (2020.01)

(52) U.S. Cl.
CPC ..... *B63H 16/04* (2013.01); *B63B 32/40* (2020.02); *B63H 2016/043* (2013.01)

(58) Field of Classification Search
CPC . E21B 17/012; B63H 16/04; B63H 2016/043; B63B 32/70
See application file for complete search history.

(56) References Cited

U.S. PATENT DOCUMENTS 1,894,874 A * 1/1933 Kask ..... A63B 35/06 441/56
7,628,665 B1 * 12/2009 Cook ..... E21B 17/012 405/195.1
2008/0057802 A1 * 3/2008 Wilkinson ..... B63H 16/04 440/101
2016/0052611 A1 * 2/2016 Seckinger ..... B63C 9/28 416/70 R

* cited by examiner

*Primary Examiner* — Andrew Polay
(74) *Attorney, Agent, or Firm* — Benjamin Aaron Adler

(57) ABSTRACT

Provided herein are flotation devices for use with a stand-up paddle and a stand-up flotation paddle. The flotation device has two hemispheres and a pair of stop collars. The hemispheres are secured to each other around the shaft of the stand-up paddle and secured to the shaft via the stop collars. The stand-up flotation paddle has the flotation device secured thereto.

18 Claims, 2 Drawing Sheets

FLOTATION DEVICE FOR A PADDLE

BACKGROUND OF THE INVENTION

Field of the Invention

The invention relates to tools for recreational water activity. More specifically, the present invention is directed to a combination paddle and flotation device.

Description of the Related Art

Stand-up paddle boarding is a popular recreational activity among tourists at water resorts. It is easy to learn. In stand-up paddle boarding, the user stands up on a paddle-board and uses a stand-up paddle to maneuver the board over waves. In contrast, in surfing, the surfer lies on the surfboard and uses the hands as paddles to maneuver the board prior to riding the wave. Stand-up paddle 20 boards are much bigger and heavier than surfboards. However, they are more stable and easier to use and hence preferred by beginners.

Currently, stand-up paddle boarding uses paddles that are of fixed length or adjustable length. These paddles may be made of light weight material like carbon nanofiber and fiberglass, which are expensive, or heavier material like aluminum and plastic, which are affordable. While many of the paddles are provided with foam inside to keep them afloat, due to the paddle construction water invariably enters the hollow cavity inside the paddle. Thus, currently available paddles are unsuitable for use as a flotation device that provides stability to the board and user.

Thus there is a need in the art for a flotation device for stand-up paddles that offers improved flotation and stability even with water inside the paddle. The present invention fulfills this longstanding need and desire in the art.

SUMMARY OF THE INVENTION

The present invention is directed to a flotation device for a stand-up paddle. The flotation device comprises a pair of flotation members that define a longitudinal opening therethrough when secured together, where the longitudinal opening has a uniform diameter sufficient to receive a shaft of a paddle therein. The flotation device also comprises means for removably securing the pair of flotation members to the shaft of the paddle and means for removably securing the pair of flotation members together after securing to the shaft of the paddle.

The present invention is further directed to a flotation paddle for use with a paddle board. The flotation paddle comprises, in combination, a stand-up paddle having a shaft with a proximal grip end and a distal blade end and the flotation device described herein removably secured around the shaft of the stand-up paddle.

The present invention is directed further to a stand-up flotation paddle. The paddle comprises a paddle body, a pair of symmetrical flotation members device, means for removably securing the pair of symmetrical flotation members to each other and a pair of stop collars. The paddle body has a paddle shaft with a grip on a proximal end and a blade on a distal end. The pair of symmetrical flotation members are each removably and oppositely secured to the paddle shaft along a longitudinal axis thereof. The paddle shaft is received within an opening formed therebetween when secured. The pair of stop collars are each removably disposed at respective proximal ends and at distal ends of the pair of symmetrical flotation members in a securing relationship to the paddle shaft.

Other and further aspects, features, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

FIG. 1A is a front view of a stand-up paddle to which is attached the flotation device. FIG. 1B is an exploded view of the flotation paddle.

FIG. 2A shows the flotation device floating on water when the user on a paddle board is stopped in the water. FIG. 2B is another view of the user using the paddle showing that the flotation device does not interfere when paddling.

DETAILED DESCRIPTION OF THE PRESENT INVENTION

Figure 1A:
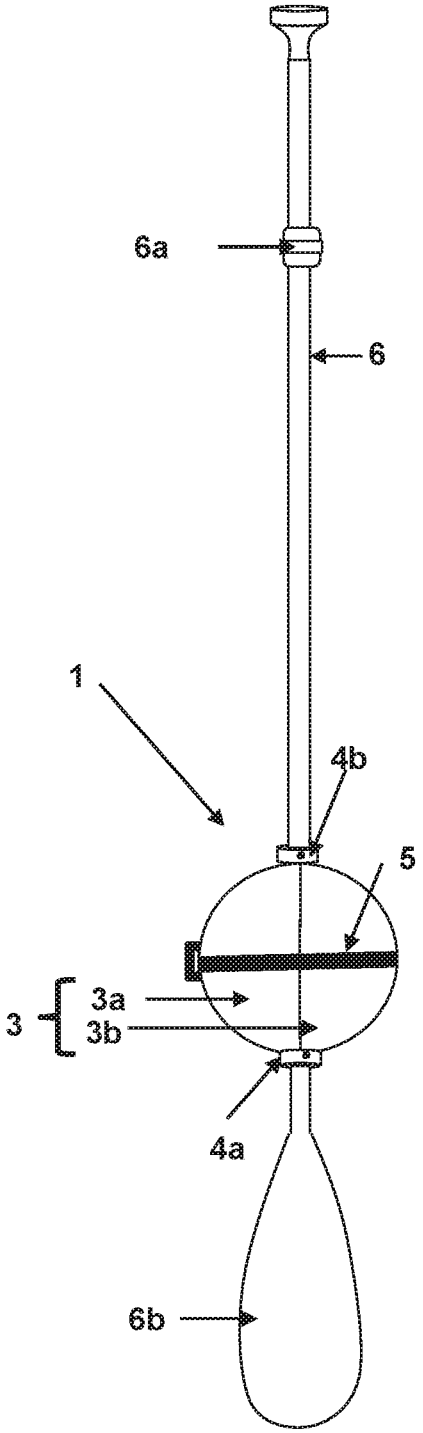
FIGS. 1A-1B shows a flotation paddle.

For convenience, before further description of the present invention, certain terms employed in the specification, examples and appended claims are collected herein. These definitions should be read in light of the remainder of the disclosure and understood as by a person of skill in the art. Unless defined otherwise, all technical and scientific terms used herein have the same meaning as commonly understood by a person of ordinary skill in the art.

The articles "a" and "an" when used in conjunction with the term "comprising" in the claims and/or the specification, may refer to "one", but it is also consistent with the meaning of "one or more", "at least one", and "one or more than one". Some embodiments of the invention may consist of or consist essentially of one or more elements, components, method steps, and/or methods of the invention. It is contemplated that any composition, component or method described herein can be implemented with respect to any other composition, component or method described herein.

The term "or" in the claims refers to "and/or" unless explicitly indicated to refer to alternatives only or the alternatives are mutually exclusive, although the disclosure supports a definition that refers to only alternatives and "and/or".

The terms "comprise" and "comprising" are used in the inclusive, open sense, meaning that additional elements may be included.

The term "including" is used herein to mean "including, but not limited to". "Including" and "including but not limited to" are used interchangeably.

As used herein, the terms "proximal" and "distal" in reference to the flotation device disclosed herein refer to those components, features, parts and aspects thereof or positioning of the same on the paddle shaft that are nearer or nearest to or farther or farthest from the grip or handle on the paddle, respectively.

As used herein, the terms "flotation members" and "symmetrical flotation members" are used interchangeably.

As used herein, the terms "stand-up paddle" and "paddle" are used interchangeably.

As used herein, the term "flotation paddle" refers to a stand-up paddle on which the flotation device described herein is secured.

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure. For example, in considering a substantially spherical flotation device, a diameter of 5.4 inches to 13.2 inches is encompassed by about 6 inches to about 12 inches.

In one embodiment of the present invention, there is provided a flotation device for a stand-up paddle, comprising a pair of flotation members defining a longitudinal opening therethrough when secured together, said longitudinal opening having a uniform diameter sufficient to receive a shaft of a paddle therein; means for removably securing the pair of flotation members to the shaft of the paddle; and means for removably securing the pair of flotation members together after securing to the shaft of the paddle.

In this embodiment, the means for removably securing the pair of flotation members to the shaft may comprise a pair of stop collars. In an aspect thereof, the pair of stop collars are removably disposed at respective proximal ends and at distal ends of the pair of flotation members in a securing relationship to the shaft. Also, the means for removably securing the pair of flotation members together may be a cable tie, a strap or an elastic band. In addition, the pair of flotation members may form a substantially spherical unit when secured together around the shaft of the paddle. In an aspect thereof, the substantially spherical unit has a diameter of about 6 inches to about 12 inches. Furthermore, the flotation device may comprise a water-buoyant foam. Particularly, the water-buoyant foam is a buoyant polyethylene foam, a buoyant polypropylene foam or a styrofoam.

In another embodiment of the present invention, there is provided a flotation paddle for use with a paddleboard, comprising, in combination, a stand-up paddle comprising a shaft with a proximal grip end and a distal blade end; and the flotation device, as described supra, removably secured around the shaft of the stand-up paddle. In this embodiment, the stand-up paddle may have an adjustable length.

In yet another embodiment of the present invention, there is provided a stand-up flotation paddle, comprising a paddle body comprising a paddle shaft with a grip on a proximal end and a blade on a distal end thereof; a pair of symmetrical flotation members each removably and oppositely secured to the paddle shaft along a longitudinal axis thereof, where the paddle shaft is received within an opening formed therebetween when secured; means for removably securing the pair of symmetrical flotation members to each other along the longitudinal axis of the paddle shaft; and a pair of stop collars each removably disposed at respective proximal ends and at distal ends of the pair of symmetrical flotation members in a securing relationship to the paddle shaft.

In this embodiment, the means for removably securing the symmetrical flotation members to each other may be a cable tie, a strap or an elastic band. In an aspect thereof, the means for removably securing the symmetrical flotation members to each other is a cable tie. Also, each of the stop collars in the pair have an inner diameter equal to an outer diameter of the paddle shaft when secured thereto. In addition, the paddle shaft may have an adjustable length.

In this embodiment, each of the symmetrical flotation members in the pair may be substantially hemispherical. The pair of symmetrical flotation members form a substantially spherical flotation device when secured along the longitudinal axis of the paddle shaft. Particularly, the substantially spherical flotation device has a diameter of about 6 inches to about 12 inches. In addition, each of the symmetrical flotation members may comprise a water buoyant foam. Representative examples of a water-buoyant foam include but are not limited to a buoyant polyethylene foam, a buoyant polypropylene foam or a styrofoam.

Provided herein is a flotation device for use with a stand-up paddle such as during paddle boarding. The flotation device provides stability to a user standing on a paddleboard in the same manner that an outrigger provides stability to a boat. The flotation device is secured to the paddle shaft preferably near the blade on the distal end of the paddle such that when a user is at a standstill of the paddleboard, the flotation device keeps the blade floating near the surface of the water. Conversely, when the user is paddling the floatation device does not come into contact with the water and does not interfere with the stroking motion to propel the paddleboard.

Generally, the flotation device comprises a pair of flotation members or symmetrical flotation members, for example, but not limited to, a pair of hemispherical members, shaped so that a longitudinal opening is formed therebetween when the members are secured to each other. The longitudinal opening has a diameter sufficient to receive and securely encircle the paddle shaft along its longitudinal axis, particularly along a distal length of the shaft.

When secured together the flotation device may have a diameter about 6 inches to about 12 inches. The diameter may be chosen based on the length of the paddle shaft from the blade to the grip, that is, a longer length correlates to a greater diameter for better stabilization. The flotation device must be made of a buoyant material that is lightweight to not overly increase the weight of the paddle, but able to stabilize the paddle and user on the paddleboard when the blade is stationary in the water. An example of a suitable material is a buoyant foam such as, but not limited to, a buoyant polyethylene foam, a buoyant polypropylene foam or a styrofoam. Optionally, the buoyant foam may be coated with a lightweight, waterproof material, for example, a vinyl or lightweight plastic.

The flotation device comprises means to secure the flotation members to each other when disposed around the shaft of the stand-up paddle. These means may be, but not limited to, a cable tie or zip tie, a strap or an elastic band or any similar securing means known and commercially available. In one preferred aspect, the means for securing the flotation members together is the cable tie or zip tie.

The flotation device also comprises means to secure the flotation members to the paddle shaft. Although not limited to, these are generally a pair of collars configured to be secured to a shaft or other tubular structure, for example, a pair of stop collars as are known and standard in the art. The collars or stop collars are disposed at the proximal ends and at the distal ends of the flotation members near the longitudinal opening along the flotation members. Screws in the stop collars secure the flotation members to the paddle shaft, whereby the flotation members are held in place on the shaft and do not slide as the paddle is moved.

Also provided is a stand-up flotation paddle that has the flotation device secured thereto. The stand-up paddle may be any commercially available paddle. The stand-up paddle may be of any length as is known in the art or may be adjustable for length depending upon the height and/or personal preferences of the user. In paddle boarding, a recommended length is about 9 or 10 inches taller than the user. The flotation device may be any device described herein and is secured around the shaft of the stand-up paddle as described herein.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1A shows a stand-up flotation paddle 1 showing the flotation device 3 secured around a paddle shaft 6 using cable tie 5. The paddle shaft has a grip 6*a* on a proximal end, which enables a user to grip and use the paddle. A blade 6*b* attached on a distal end helps the user push the water when riding the paddleboard. A pair of stop collars 4*a*, 4*b* secure the flotation device to the paddle shaft.

Figure 1B:
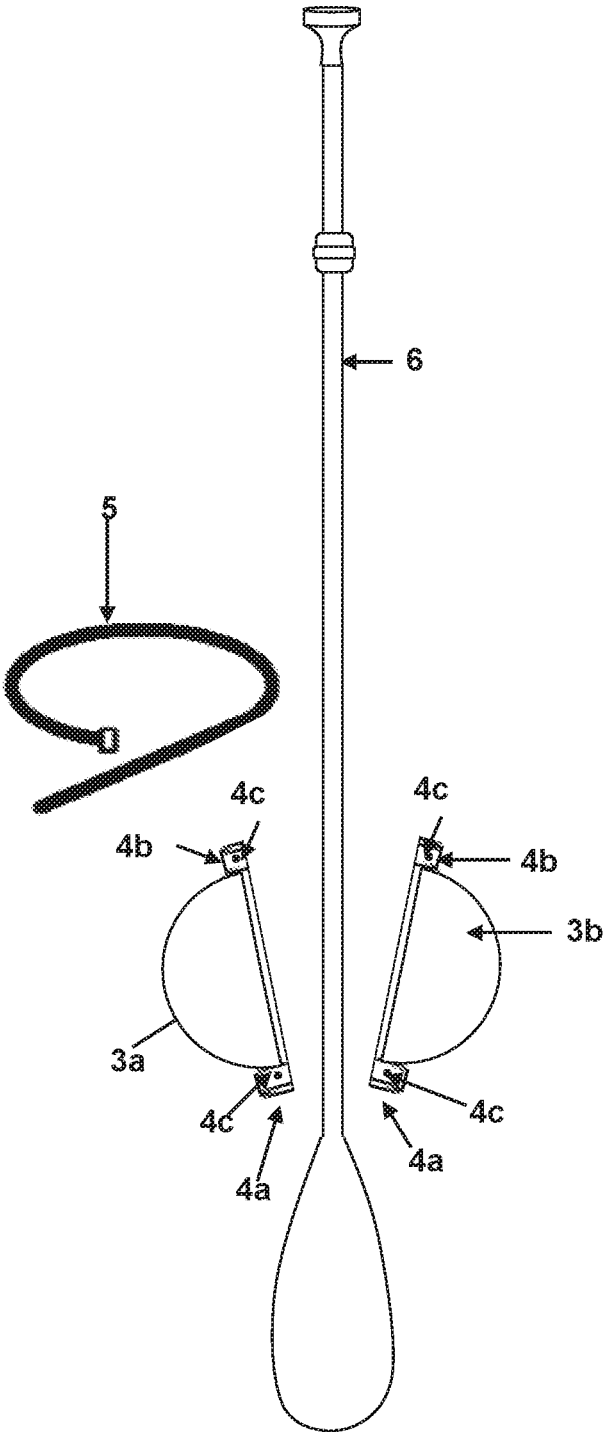

With continued reference to FIG. 1A, FIG. 1B is an exploded view of the stand-up flotation paddle showing the two hemispheres 3*a* and 3*b* of the flotation device. Cable tie 5 secures the two hemispheres. Stop collars 4*a* and 4*b* and screws 4*c*, secure the two hemispheres to the paddle shaft.

Figure 2A:
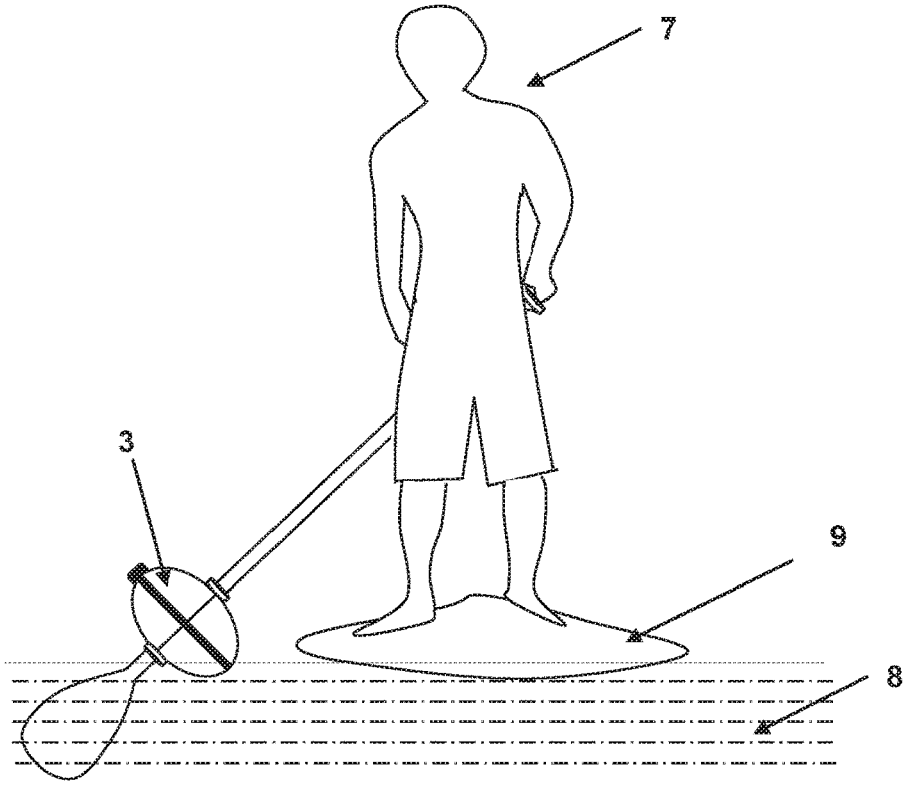
FIGS. 2A-2B shows a user using the flotation paddle.

FIG. 2A shows a paddle boarder 7 standing still in water 8 on a paddleboard 9 when the flotation device provides stability.

Figure 2B:
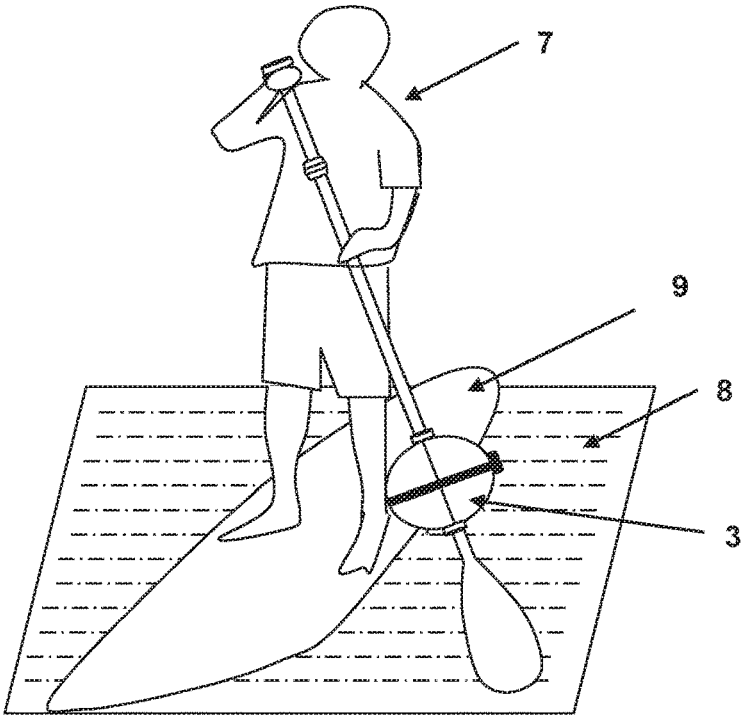

With continued reference to FIG. 2A, FIG. 2B shows that the floatation device does not interfere when the paddle-boarder is paddling through the water.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention.

What is claimed is:

1. A flotation device for a stand-up paddle, comprising:

a pair of flotation members defining a longitudinal opening therethrough when secured together, said longitudinal opening having a uniform diameter sufficient to receive a shaft of a paddle therein;

a pair of stop collars removably disposed at respective proximal ends and at distal ends of the pair of flotation members in a securing relationship to the shaft; and means for removably securing the pair of flotation members together after securing to the shaft of the paddle.

2. The flotation device of claim 1, wherein the means for removably securing the pair of flotation members together is a cable tie, a strap or an elastic band.

3. The flotation device of claim 1, wherein the pair of flotation members form a substantially spherical unit when secured together around the shaft of the paddle.

4. The flotation device of claim 3, wherein the substantially spherical unit has a diameter of about 6 inches to about 12 inches.

5. The flotation device of claim 1, wherein the flotation device comprises a water-buoyant foam.

6. The flotation device of claim 5, wherein the water buoyant foam is a buoyant polyethylene foam, a buoyant polypropylene foam or a styrofoam.

7. A flotation paddle for use with a paddleboard, comprising, in combination:

a stand-up paddle comprising a shaft with a proximal grip end and a distal blade end; and the flotation device of claim 1 removably secured around the shaft of the stand-up paddle.

8. The flotation paddle of claim 7, wherein the stand-up paddle has an adjustable length.

9. A stand-up flotation paddle, comprising:

a paddle body comprising a paddle shaft with a grip on a proximal end and a blade on a distal end thereof;

a pair of symmetrical flotation members each removably and oppositely secured to the paddle shaft along a longitudinal axis thereof, said paddle shaft received within an opening formed therebetween when secured;

means for removably securing the pair of symmetrical flotation members to each other along the longitudinal axis of the paddle shaft; and a pair of stop collars each removably disposed at respective proximal ends and at distal ends of the pair of symmetrical flotation members in a securing relationship to the paddle shaft.

10. The stand-up flotation paddle of claim 9, wherein the means for removably securing the symmetrical flotation members to each other is a cable tie, a strap or an elastic band.

11. The stand-up flotation paddle of claim 10, wherein the means for removably securing the symmetrical flotation members to each other is a cable tie.

12. The stand-up flotation paddle of claim 9, wherein each of said stop collars in the pair have an inner diameter equal to an outer diameter of the paddle shaft when secured thereto.

13. The stand-up flotation paddle of claim 9, wherein the paddle shaft has an adjustable length.

14. The stand-up flotation paddle of claim 9, wherein each of the symmetrical flotation members in the pair is substantially hemispherical.

15. The stand-up flotation paddle of claim 14, wherein the pair of symmetrical flotation members form a substantially spherical flotation device when secured along the longitudinal axis of the paddle shaft.

16. The stand-up flotation paddle of claim 15, wherein the substantially spherical flotation device has a diameter of about 6 inches to about 12 inches.

17. The stand-up flotation paddle of claim 9, wherein each of the symmetrical flotation members comprises a water buoyant foam.

18. The stand-up flotation paddle of claim 17, wherein the water buoyant foam is a buoyant polyethylene foam, a buoyant polypropylene foam or a styrofoam.

* * * * *